US005095589A

United States Patent [19]

Ritchie et al.

[11] Patent Number: 5,095,589

[45] Date of Patent: Mar. 17, 1992

[54] SELF-LOCKING SAFETY PIN

[76] Inventors: Frances Ritchie, R.R. #2, Woodlawn, Ontario, Canada, K0A 3M0; Mark Ritchie, Apt. #307, 2000 Sheppard Ave., Downsview, Ontario, Canada, M3N 1A2

[21] Appl. No.: 648,742

[22] Filed: Jan. 31, 1991

[30] Foreign Application Priority Data

Jun. 18, 1990 [CA] Canada ..... 2019184

[51] Int. Cl.[5] ..... A44B 9/12

[52] U.S. Cl. ..... 24/13; 24/302; 24/709.5

[58] Field of Search ..... 24/3 M, 13, 300–302, 24/601.6, 709.5, 710.4, 600.7, 598.2; 606/234, 235

[56] References Cited

U.S. PATENT DOCUMENTS

| | | | |
|---|---|---|---|
| 2,117,005 | 5/1938 | Krantz | 24/301 |
| 4,000,627 | 1/1977 | Wahlbeck | 24/598.2 X |
| 4,985,968 | 1/1991 | Hooper | 24/302 |

FOREIGN PATENT DOCUMENTS

| | | | |
|---|---|---|---|
| 1029603 | 5/1958 | Fed. Rep. of Germany | 24/600.7 |
| 1124234 | 10/1956 | France | 24/600.7 |
| 2209 | of 1887 | United Kingdom | 24/709.5 |
| 3073 | of 1890 | United Kingdom | 24/709.5 |
| 434625 | 9/1935 | United Kingdom | 24/709.5 |
| 2106370 | 4/1983 | United Kingdom | 24/600.7 |

*Primary Examiner*—James R. Brittain
*Attorney, Agent, or Firm*—Burke-Robertson

[57] ABSTRACT

A self-locking safety pin comprising a tubular body which extends in circular fashion in a plane between opposed, spaced ends, the ends disposed to form a gap in the circular body, and an elongated curved tongue slidably mounted to extend, under bias, between a closed position extending across the gap from one end of the body into the other, and an open position in which the tongue is withdrawn into said one end of the body. The free end of the tongue is tapered to a fabric-piercing point. An actuator, by which the tongue may be moved to open position, extends from the tongue through an elongated slot on the body to the exterior surface of the body. An anchor is also positioned on the exterior surface of the body, spaced from the actuator. The actuator, anchor and slot are located on the side surface of the body, opposite from the gap.

6 Claims, 1 Drawing Sheet

SELF-LOCKING SAFETY PIN

FIELD OF THE INVENTION

The present invention relates to a self-locking safety pin for holding objects or securing to fabrics.

BACKGROUND OF THE INVENTION

Locking safety pins of general background are described and illustrated in Petti U.S. Pat. No. 3,475,796 issued Nov. 4, 1969; Petti U.S. Pat. No. 2,475,251 issued July 5, 1949; Wagner U.S. Pat. No. 3,570,076 issued Mar. 16, 1971; Wagner U.S. Pat. No. 4,044,429 issued Aug. 30, 1977 and Canadian Patent No. 694,729 of Stanton issued Sept. 22, 1964. These safety pins generally require the pin to be removed from a casing in which it is normally housed, by relative rotation of the pin with respect to such housing so that the pin can clear overlapping, sides of the housing.

Miniature clasps have been developed, for example, in the jewelry field, to lock miniature chains of jewelry in position around a person's neck. Such clasps are in the form of a tubular body extending in circular fashion in a plane between opposed, spaced ends, the ends forming a tiny gap through which a link of the chain can extend. An elongated tongue, curved in conformity with the tubular body, is slidably mounted within the tubular body to move between closed position extending across the gap from one end of the body to other and open position in which the tongue is withdrawn into said one end of the body. A biasing means, for example a spring, is housed within the body and extends between a plug means secured in the tube and an end of the tongue to which it is secured, to urge the tongue towards and maintain it in closed position. An actuation means, such as an outwardly extending post is secured to the tongue and extends to the exterior of the body. That post is relatively movable with respect to the body under action of one's finger so that the tongue may be moved against the urging of the biasing means from closed to open position. A slot is provided in the body to receive and guide a portion of the post during movement. The clasp of this type is normally secured to one end of a jewelry chain and releasably receives, through the gap, a link at the other end of the chain when the tongue has been moved to open position.

It is an object of the present invention to provide an alternative construction of a safety pin which permits a variety of alternative uses thereof. It is a further object of the present invention, to provide a self-locking safety pin.

SUMMARY OF THE INVENTION

In accordance with the present invention, there is provided a self-locking safety pin of the type comprising a tubular body which extends in circular fashion in a plane between opposed, spaced ends, with the ends disposed to form a gap in the body. The gap is sufficiently wide to receive a fold of material. The tubular body has inner and outer peripheral surfaces and side surfaces extending therebetween. An elongated tongue is curved in conformity with the tubular body and has a free end. The free end of the tongue is tapered to a point to permit ready piercing of a fabric. The tongue is slidably mounted within the tubular body to move between closed position extending across the gap from one end of the body into the other, and open position in which the free end of the tongue is withdrawn from said other end of the body into said one end of the body. Biasing means are housed within the body to urge the tongue towards and maintain it in closed position. Actuation means on the exterior surface of the body are associated with the tongue to enable a person to cause relative movement of the tongue with respect to the body to move the tongue against the urging of the biasing means from closed to open position. A slot in the body is provided to receive a portion of the actuation means and guide it during movement. An anchor means is positioned on the body and spaced from the actuation means to facilitate manipulation of the actuation means.

It is preferred that the actuation means and the slot means be located on a portion of the body opposite from the gap.

In a further preferred embodiment of the present invention arms of a U-shaped extension are secured to the outer peripheral surface of the body opposite from the gap to form a means by which other objects may be attached to the body.

The safety pin according to the present invention is of necessity of a significantly larger size than the conventional jewellery chain clasp, and as such has many uses besides as a safety pin. For instance, it may be used as a key chain holder, security badge, earring (for pierced ears), zipper puller, pocket watch attachment, holder for purses and wallets, front adjuster for bras or slips, pen holder or glass holder (with added attachments) and the like. In the safety pin embodiment of the present invention, relative rotation of the pin (tongue) is not required. The pin is simply retracted by pushing the actuation means against the urging of the biasing means to move the pin into open position. In this manner, particularly for example where the safety pin would be used on clothing for infants, a very safe construction is provided.

BRIEF DESCRIPTION OF THE DRAWINGS

These and other objects and advantages of the invention will become apparent upon reading the following detailed description and upon referring to the drawings in which.

Figure 1:
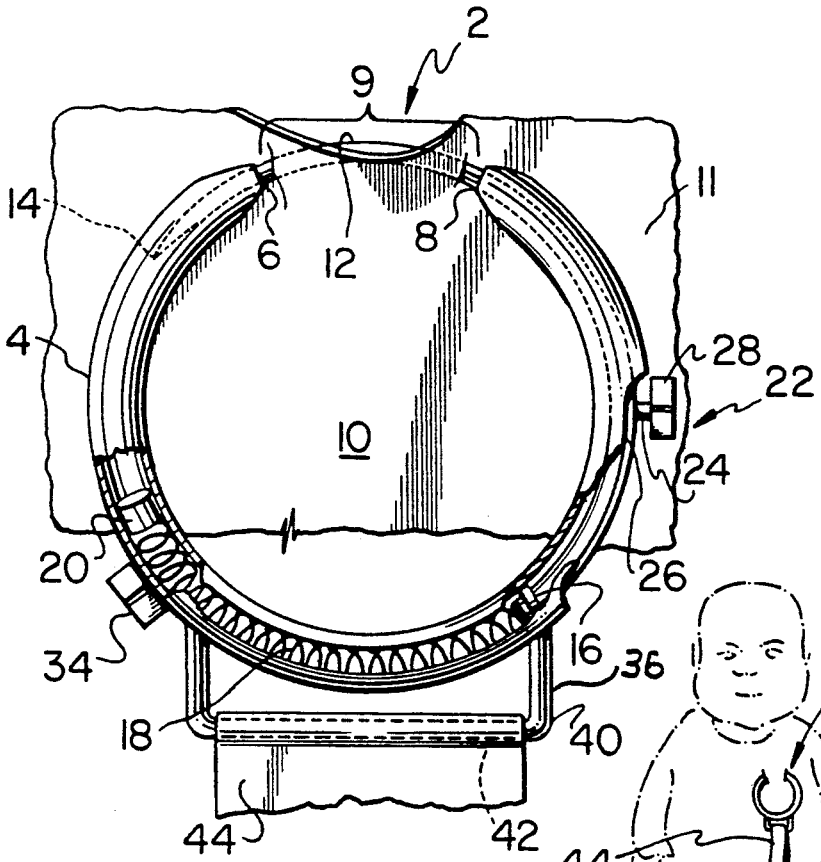
FIG. 1 is a partial perspective view, from the front, of a safety pin in with the present invention.

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Turning to FIG. 1 there is illustrated a self-locking safety pin 2 in accordance with the present invention. Safety pin 2 comprises a tubular body 4 extending in circular fashion as illustrated, in a plane between opposed, spaced ends 6 and 8, these ends forming a gap 9 providing access or entrance to the open, central portion 10 of body 4. Gap 9 is of sufficient width to readily receive a fold of fabric 11 or the like, for the purpose of pinning.

An elongated tongue 12, curved as illustrated in conformity with the curvature of tubular body 4, extends in closed position as illustrated across gap 9 with its free end 14 housed within tubular body 4 beyond end 6. Free end 14 is tapered to a point, as illustrated, to enable it to readily pierce fabric 11. The other end 16 of tongue 12 is secured to one end of coil spring 18, as illustrated, coil spring 18 being positioned within body 4 between a plug 20 and end 16 of tongue 12. The openings in ends 6 and 8 of body 4 are constricted, as illustrated, to facilitate guidance of tongue 12 and ensure that free end 14 is securely held when in closed position.

An actuator 22 is provided in the form of a post 24 secured to tongue 12 near its lower end 16, this post extending through elongated slot 26 in body 4 and terminating in a finger press button 28 externally positioned with respect to body 4. Pressing finger press button 28 downwardly to compress spring 18 causes tongue 12 to slide within tubular body 4, in a clockwise fashion, until the end 14 of tongue 12 has cleared or substantially cleared gap 9. With tongue 12 in this open position, gap 9 is then open to enable an object to be passed through gap 9 into the center of body 4 or, as in the illustrated embodiment, a fold of fabric 11 to be placed in the gap, between ends 6 and 8, so that, upon release of finger button 28 by the user, free end 14 passes through the fabric fold as it returns through end 16 into closed position as illustrated. In this manner, tongue 12 acts as a curved safety pin.

As can be seen, to facilitate the handling and operation of this self-locking safety pin mechanism, finger press button 28 (and associated post 24) and slot 26 are positioned on a side surface of body 14, remote from gap 9. As well, to facilitate manipulation of button 28 to open tongue 12, an finger anchor means 34, spaced from finger press button 28 as illustrated, is provided.

Figure 2:
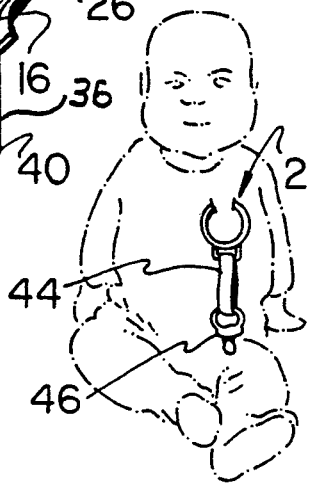
FIG. 2 is a schematic perspective view of an infant wearing a clasp according to FIG. 1 to which is secured a soother.

In the illustrated embodiment of FIGS. 1 and 2, arms 36 of a U-shaped extension 40 are secured to the outer peripheral surface of body 4 at a location opposite from gap 9. To transverse 10 member 42 of extension 40 is secured a ribbon 44, which ribbon is also looped about an infant soother 46 (FIG. 2).

In another embodiment of this safety pin version of the invention, clasp 2 of the free end of tongue 12 shaped as a pin can be used as a safety pin for baby's cloth diapers, either with or without U-shaped attachment 40. Of course, tubular body 4 may be appropriately coloured.

Figure 3:
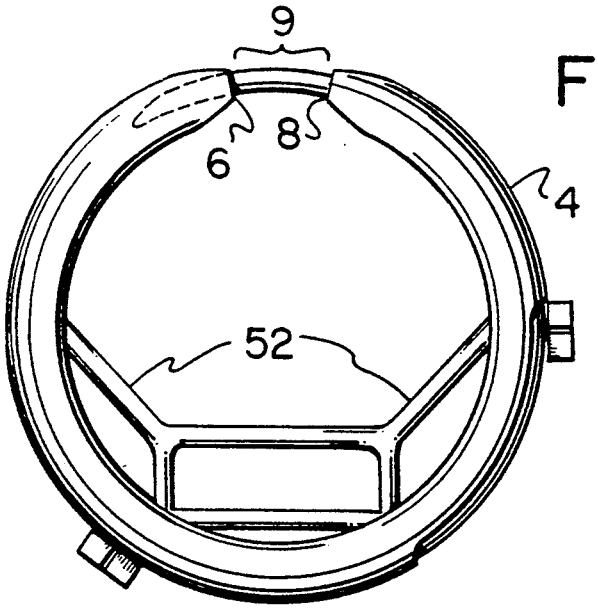
FIG. 3 is a partial perspective view of an alternative embodiment on pin in accordance with the present invention.

In the embodiment of FIG. 3, brace means 52 extend between interior peripheral surfaces of body 4, as illustrated, to provide greater stability thereto, and minimize relative movement of ends 6 and 8 with respect to each other.

As previously indicated, the construction of the present invention enables the safety pin to have many and varied uses, which uses are intended to be included within the scope of this invention. For example, by lessening the distance of gap 9 between ends 6 and 8, an effective holder for keys or the like may be provided. In this embodiment, the free end 14 of tongue 12 may be less pointed and more rounded or flattened.

Thus it is apparent that there has been provided in accordance with the invention a self-locking safety pin that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claim as our invention:

1. A self-locking safety pin comprising a tubular body extending in circular fashion in a plane between opposed, spaced ends, said ends disposed to form a gap in the body, the gap being sufficiently wide to receive a fold of material, the tubular body having inner and outer peripheral surfaces and side surfaces extending therebetween, an elongated tongue curved in conformity with the tubular body and having a free end, the free end of the tongue being tapered to a point to permit ready piercing of a fabric, the tongue being slidably mounted within the tubular body to move between:

(i) closed position extending across the gap from one end of the body into the other, and (ii) open position in which the free end of the tongue is withdrawn from said other end of the body, into said one end of the body, biasing means housed within the body to urge the tongue towards and maintain it in closed position, actuation means on the body associated with the tongue to enable a person to cause relative movement of the tongue with respect to the body to move the tongue against the urging of the biasing means from closed to open position, slot means in the body to receive a portion of said actuation means and guide it during movement and anchor means positioned on the body and spaced from said actuation means to facilitate manipulation of the actuation means, the actuation means, sot means and the anchor means being located on said outer peripheral surface of the tubular body in a position substantially opposite the gap, the ends of body being formed with constricted openings to facilitate guidance of the tongue and ensure that the free end of the tongue is securely held when in closed position.

2. A safety pin according to claim 1 wherein the biasing means is a coil spring extending between a plug secured within the body and the tongue.

3. A safety pin according to claim 1 wherein arms of a U-shaped extension are secured to the outer peripheral surface of the body opposite from the gap to form a means by which other objects may be attached to the clasp.

4. A safety pin according to claim 3 wherein one end of a ribbon of material is secured to the U-shaped extension, and the other end is secured to an infant soother.

5. A safety pin according to claim 1 further provided with brace means extending between interior peripheral surfaces of the body to provide greater stability thereto and minimize relative movement of the ends with respect to each other.

6. A self-locking safety pin intended for use as a holder for keys and the like comprising a tubular body extending in circular fashion in a plane between opposed, spaced ends, said ends disposed to form a gap in the body wise enough for passage for keys and the like, the gap being sufficiently wide to receive objects to be held on the safety pin, the tubular body having inner and outer peripheral surfaces and side surfaces extending therebetween, an elongated tongue curved in conformity with the tubular body and having a free end, the tongue being slidably mounted within the tubular body to move between:

(i) closed position extending across the gap from one end of the body into the other, and (ii) open position in which the free end of the tongue is withdrawn from said other end of the body, into said one end of the body, biasing means housed within the body to urge the tongue towards and maintain it in closed position, actuation means on the body associated with the tongue to enable a person to cause relative movement of the tongue with respect to the body to move the tongue against the urging of the biasing means from closed to open position, slot means in the body to receive a portion of said actuation means and guide it during movement and anchor means positioned on the body and spaced from said actuation means to facilitate manipulation of the actuation means, the actuation means, slot means and the anchor means being located on said outer peripheral surface of the tubular body in a position substantially opposite the gap, the ends of the body being formed with constricted openings to facilitate guidance of the tongue and ensure that the free end of the tongue is securely held when in closed position.

* * * * *